United States Patent [19]

Henrich

[11] 4,257,563

[45] Mar. 24, 1981

[54] APPARATUS AND PROCESS FOR PRODUCING WOOD PULP IN A PRESSURIZED WOOD GRINDER

[75] Inventor: Hans Henrich, Heidenheim, Fed. Rep. of Germany

[73] Assignee: J.M. Voith GmbH, Fed. Rep. of Germany

[21] Appl. No.: 35,256

[22] Filed: May 2, 1979

[30] Foreign Application Priority Data

Nov. 29, 1978 [DE] Fed. Rep. of Germany ..... 2851601

[51] Int. Cl.[3] ..... B02C 23/38

[52] U.S. Cl. ..... 241/17; 241/28; 241/41; 241/43; 241/66; 241/152 A

[58] Field of Search ..... 241/280, 186.2, 186 R, 241/152 A, 152 R, 21, 248, 28, 29, 23, 17, DIG. 14, 41, 43, 65, 66, 261.2

[56] References Cited

U.S. PATENT DOCUMENTS

| | | | |
|---|---|---|---|
| 3,245,868 | 4/1966 | Espenmiller et al. | 241/28 X |
| 3,948,449 | 4/1976 | Logan et al. | 241/28 X |
| 4,012,279 | 3/1977 | Selander et al. | 241/28 X |
| 4,072,274 | 2/1978 | Syrjanen | 241/28 |

*Primary Examiner*—Mark Rosenbaum

*Attorney, Agent, or Firm*—Ostrolenk, Faber, Gerb & Soffen

[57] ABSTRACT

The disclosure concerns both a process and an apparatus for producing wood pulp. Wood to be pulped is fed into a housing where the wood is ground. The housing is pressurized above atmospheric pressure. Water at a temperature over 100° C. is fed to the pressurized housing in the grinding zone. The wood pulp produced by grinding is collected and is conveyed through a worm conveyor which causes the water in the pulp to be removed therefrom, while the pulp and the water removed therefrom are maintained at elevated pressure. The water under pressure is returned to the grinding zone in the housing. The wood pulp is thereafter returned to atmospheric pressure. Various pressure lock devices for transmitting the wood pulp from being under pressure to atmospheric pressure are disclosed including a nozzle, a pressure lock device, a hydrocyclone and/or a disc refiner.

15 Claims, 1 Drawing Figure

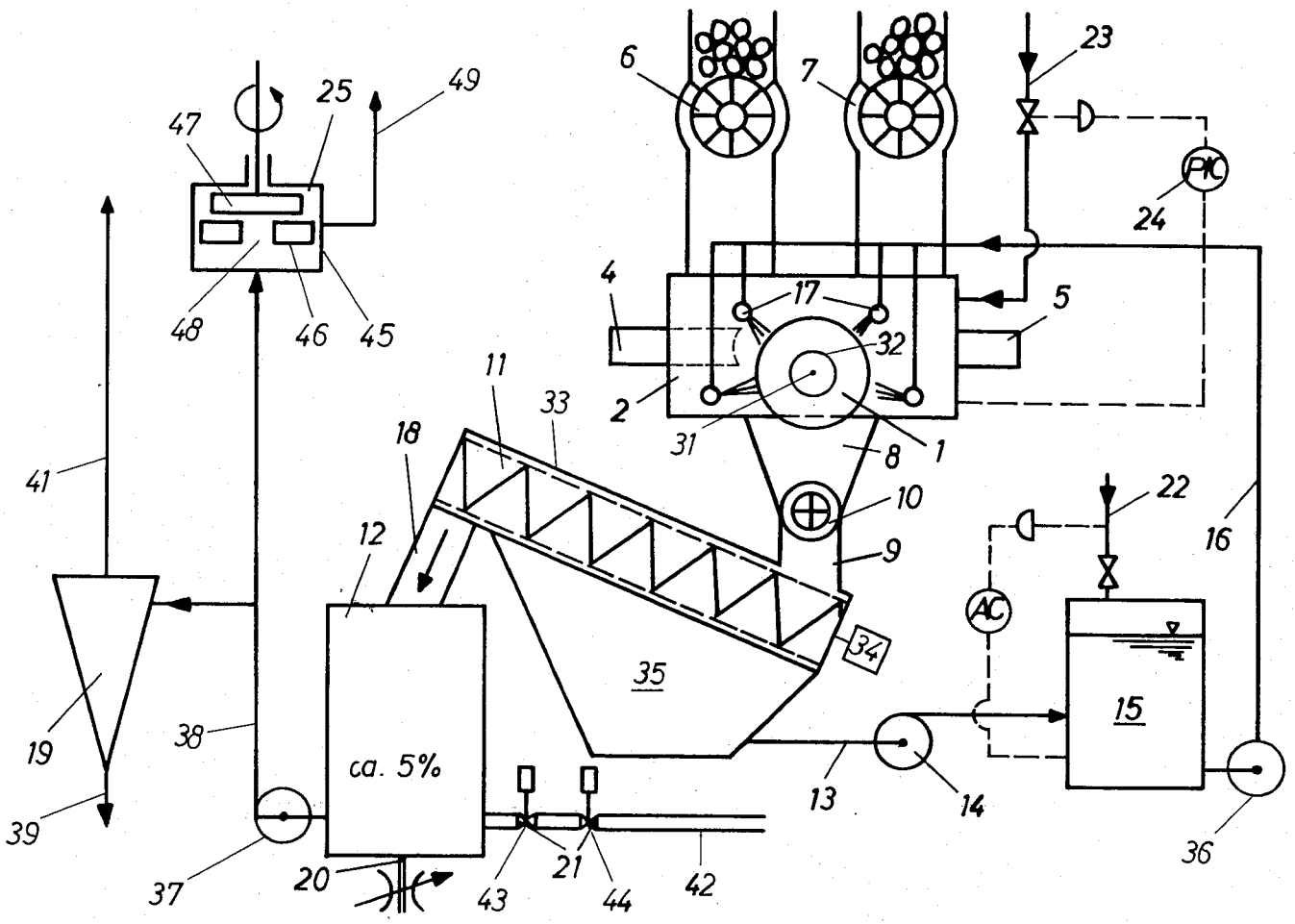
ca. 5%

APPARATUS AND PROCESS FOR PRODUCING WOOD PULP IN A PRESSURIZED WOOD GRINDER

BACKGROUND OF THE INVENTION

The present invention relates to a process and apparatus for producing wood pulp using a wood grinder and wherein water is fed to the grinding zone. The grinding is effected in a pressurized grinding zone and the water temperature is kept over 100° C. This invention is an improvement upon the disclosure of U.S. application Ser. No. 21,070 filed Mar. 16, 1979 by Helmut Thumm, entitled "Process and Apparatus for Producing Wood Pulp", commonly owned by the Assignee hereof.

To grind wood under a positive pressure above atmosphere, the housing in which grinding is performed is sealed from the atmosphere. Because the housing is pressurized, it is possible to grind with water at higher temperatures. This produces better and more uniform quality wood pulp, in which the proportion of long fibers and the tear length of the wood pulp are increased. For further details concerning this process and concerning apparatus suitable for performing the process, see the aforesaid application.

After the wood has been ground into pulp, it is necessary to bring the wood pulp, which has a pulp consistency range of about 1 to 2.5 percent of absolute dryness, back to atmospheric pressure.

Upon the discharge of the wood pulp from the grinder housing, a very large amount of heat also leaves the parts of the apparatus which are under pressure. This heat can be recovered only by means of relatively large and complicated heat-recovery systems. Furthermore, steam washing and chemical steam neutralization are also necessary. Due to the low temperature of the vapors recovered, the waste heat can be used in this connection only for the pre-heating of the water to be used in the grinding zone up to 100° C. But water at a higher temperature is required for grinding effectively. In order to maintain the heat equilibrium required for the grinding process, therefore, two to three tons of steam per ton of pulp per hour must be supplied to the grinding zone.

SUMMARY OF THE INVENTION

The primary object of the present invention is to reduce the energy required for producing wood pulp under pressure.

It is another object of the invention to recapture energy used during the pulping process for reuse.

It is a further object of the invention to accomplish the foregoing objects in an effectively pressure sealed housing.

According to the invention, after the wood is ground into pulp, the wood pulp is dewatered while it remains pressurized. The water obtained thereby, which also is still under pressure, is returned to the grinding zone. The concentrated, dewatered wood pulp is then brought back to atmospheric pressure.

Following grinding, the wood pulp, has a normal pulp consistency of about 1 to 2.5 percent of absolute dryness. The pulp is dewatered before the pressure thereon is reduced. The still heated water, remaining under pressure, is returned to the grinding zone. Because of the use of the heated, pressurized water, less energy is required for this grinding process. For instance, if the suspension of ground wood pulp is dewatered and thickened to more than 5% of absolute dryness, no additional fresh steam is required. The condensate obtained during dewatering can be returned in its entirety to the process. It is therefore advantageous if the pulp is dewatered to a pulp density of more than 5% of absolute dryness.

A preferred embodiment of apparatus according to the invention comprises a wood grinder having a grinding means, such as a stone or roller, which is supported in a housing. A wood feed chute delivers wood into the housing. The feed chute may be provided with pressure-sealing locks so that housing pressure is maintained. A hydraulic or mechanical wood advancing means in the housing moves the wood against the grinder. A water supply delivers high temperature water into the pressurized grinding zone. A collecting trough for the wood pulp is positioned below the grinding means. Within or downstream of the collecting trough, there is a water-removal means for removing water from the pulp. It comprises a worm that moves the pulp along and compresses it, which extracts water from the pulp. A water discharge pipe leading from the worm is connected with a pressurized water container. A return line from the water container leads to the grinding zone in which the grinding means is located. There is a wood pulp discharge conduit from the worm that leads to a pressure lock discharge device through which the pulp passes and the pulp is then discharged to return to atmospheric pressure.

The pressure lock discharge device for the thickened wood pulp may be comprised of a suitable pressure lock chamber, a nozzle or a disk refining apparatus. The last mentioned of these is comprised, for instance, of rotor and stator disks cooperate to refine pulp passing out of the pressurized wood pulp discharge conduit. The pulp may also or alternatively pass through a subsequent hydrocyclone in which impurities and wood splinters are removed.

Other objects and features of the invention are described below with reference to the accompanying drawing.

DESCRIPTION OF THE DRAWING AND OF A PREFERRED EMBODIMENT

The drawing is a schematic view of an apparatus for producing wood pulp according to the invention.

The drawing shows a double-press grinder which is pressure-sealed. Grinding means comprised of a hard, rough surface, e.g., a stone roller 1, is located in a closed, pressure sealed housing 2. The roller 1 is supported in the housing 2 about the roller axis 31 and the roller is rotatable about the axis 31 by the motor 32. The wood to be ground is pressed against the roller 1 by hydraulically-actuated pressing shoes 4 and 5, which are reciprocated sideways in the drawing, to alternately press the wood in the housing to the roller or to retract to receive more wood. The wood to be ground is delivered into the housing 2 through pressure-sealing locks 6 and 7. For further description of the foregoing structure, see the aforementioned U.S. application.

Below the grinding roller 1, there is a pulp trough 8. A connecting conduit 9 extends below trough 8. Between the pulp trough 8 and the conduit 9 there is a wood chip divider 10, which breaks up remaining larger chips or slabs of wood, as described in further detail in the aforesaid U.S. application.

The conduit 9 discharges into a rotatable, water removal worm 11, comprised of a helical auger that sits in and rotates inside of the obliquely inclined pipe 33. The auger is helically profiled or threaded so that the wood pulp is moved up the inclined tube 33 as the worm rotates. This compresses the wood pulp, and the water separates therefrom. The worm 11 is rotated by conventional motor drive means 34. The pipe 33 is pressurized like the housing 2. The wood pulp is thickened in this manner from about 1.5 to more than 5 percent of absolute dryness. The thickened wood pulp at the top of the pipe 33 is introduced through a wood pulp outlet conduit 18 into a pressure-sealed, pressurized pulp collection tank 12. The water that separates from the pulp in the pipe 33 is still hot and is still under pressure. It settles into collector 35 and is conducted from there through a water discharge pipe 13 and a pump 14 to a pressure-fed water container 15. From the water container 15, a return line 16 leads through the pump 36 back into the grinding zone of the housing 2. The pressurized, heated, returned water is sprayed through nozzles 17 onto the grinding roller 1.

For effecting removal of the wood pulp from the pulp collection container 12, four alternative apparatus are shown in the illustrated embodiment. These need not be mutually exclusive, although only one will usually be selected.

They all share the characteristic that pulp outflow is restricted and controlled so that they maintain the elevated pressure in pulp container 12 and the pulp is returned to atmospheric pressure upon passing through any of these apparatus.

The thickened wood pulp can be fed through a conventional hydrocyclone 19 from the pulp collection container 12. In this case, the pressure from within container 12, perhaps supplemented by pump 36, is utilized for delivering pulp through conduit 38 to the cyclone and for delivering pulp at a rate which causes proper functioning of the hydrocyclone. Impurities are removed in a known manner at 39 at the tip of the cone of the cyclone, while the purified wood suspension is removed without pressure at the top of the cyclone, at 41.

Alternatively, a nozzle 20 located beneath the container 12 seals the container and is opened to a varying extent to control the discharge from the container. As another alternative, a double lock means 21 in a conduit 42 communicates with the container 12. The lock means is opened in a controlled manner to release pulp, without decreasing the pressure in container 12. In this connection, only one of the locks at a time is opened, first the lock 43 nearest the container 12 to release pulp from the container 12 and trap it between locks 43 and 44, and thereafter the lock 44 further away from the container 12 to emit pulp to conduit 42 while the first lock 43 is reclosed to reseal container 12.

As a further alternative, a disk refiner means 25 may be connected to receive pulp from conduit 37,38. This breaks up the pulp fibers still further. Examples of such disk refiners are found in U.S. Pat. Nos. 3,448,934 and 3,708,130, incorporated herein by reference. In the housing 45, there is a stator disk 46. A rotor disk 47 cooperates with and rotates with respect to the stator disk. The rotor disk may be provided with teeth or bore holes for improving the break up of the pulp fibers passing between the disks. Pulp is delivered through the inlet 48 and passes between the faces of the disks 46 and 47 and thereafter moves into outlet conduit 49.

In order to make up for losses of water through the entire pumping cycle, returned water from other places is additionally fed via conduit 22 to the pressurized water container 15. There is a steam line 23, which is provided with a regulating device 24, that serves for the control of the temperature and the pressure in the grinder housing 2 to maintain it at a constant, preset level.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What I claim is:

1. A process for producing wood pulp, comprising: feeding wood into a housing; grinding the wood in the housing; pressurizing the housing, in which the wood is being ground, above atmospheric pressure;

feeding water to the zone in the housing where the wood is being ground and heating the water being fed to the wood in the housing to over 100° C.;

collecting the wood pulp thereby produced, while holding the wood pulp under pressure; removing water from the wood pulp then under pressure, while holding the water under pressure and the removed water being still heated;

said feeding of water to the zone in the housing where wood is being ground comprising feeding water that has been removed from the wood pulp and which water is still being held under pressure and is still heated.

2. The process for producing wood pulp of claim 1, wherein following the removing of water from the pulp, returning the pulp to atmospheric pressure.

3. The process for producing wood pulp of either of claims 1 or 2, wherein water is removed from the wood pulp so that the pulp is at least 5 percent of absolute dryness.

4. The process of producing wood pulp of claim 3, wherein following said grinding and before said water removal, the pulp has a consistency in the range of about 1 to 2.5 percent of absolute dryness.

5. Apparatus for producing wood pulp from wood, comprising:

a pressurized housing, sealed for enabling said housing to be pressurized above atmosphere; means for pressurizing said housing;

a wood grinder in said housing for grinding wood fed against said grinder into wood pulp;

wood feed means for feeding wood to said grinder;

water delivery means for delivering water to the zone in said housing where said grinder is grinding wood;

a wood pulp collector placed for collecting pulp ground by said grinder;

water removal means connected to said pulp collector for receiving pulp from said pulp collector and for removing water from the pulp received; a water return line from said water removal means to said water delivery means for delivering water removed from the pulp to said water delivery means;

means for also pressurizing said pulp collector and said water removal means above atmosphere, whereby the water in and removed from the wood pulp and passed through said water return line may remain always above atmospheric pressure.

6. The apparatus for producing wood pulp of claim 5, wherein said water removal means comprises a worm conveyor for wood pulp, and said worm conveyor including a worm which rotates to convey the wood pulp, while permitting the water to separate from the wood pulp; means for rotating said worm; wood pulp outlet means from said worm conveyor, to which said worm conveyor delivers wood pulp.

7. The apparatus for producing wood pulp of claim 6, wherein said worm conveyor comprises a tube having the rotatable said worm therein; said tube being inclined and said worm being profiled to move pulp up the incline of said tube.

8. The apparatus for producing wood pulp of either of claims 6 or 7, wherein said means for also pressurizing said pulp collector and said water removal means comprises said wood pulp outlet means.

9. The apparatus for producing wood pulp of claim 5, further comprising wood pulp outlet means from said water removal means, and said water removal means delivering pulp from which water has been removed to said wood pulp outlet means.

10. The apparatus for producing wood pulp of claim 9, wherein said means for also pressurizing said pulp collector and said water removal means comprises said wood pulp outlet means.

11. The apparatus for producing wood pulp of claim 10, wherein said wood pulp outlet means includes a pressure lock device.

12. The apparatus for producing wood pulp of claim 11, wherein said pressure lock device comprises a hydrocyclone.

13. The apparatus for producing wood pulp of claim 11, wherein said pressure lock device comprises a pulp collection container with a controlled outlet flow rate nozzle.

14. The apparatus for producing wood pulp of claim 11, wherein said pressure lock device comprises a pulp collection container having an outlet conduit therefrom with a double, spaced apart, set of locks therein, capable of separately opening and closing said outlet conduit.

15. The apparatus for producing wood pulp of claim 11, wherein said pressure lock device comprises disk refiner means, comprising a stator disk and a rotor disk movable with respect to said stator disk for break up fibers of wood passing between said stator disk and said rotor disk; said wood pulp outlet means delivering wood pulp to pass between said stator disk and said rotor disk and including means conducting pulp away after it has passed between those said disks.

* * * * *